US009074267B2

(12) United States Patent
Tang et al.

(10) Patent No.: US 9,074,267 B2
(45) Date of Patent: Jul. 7, 2015

(54) RAPID FABRICATION OF POROUS METAL-BASED BIOMATERIAL BY MICROWAVE SINTERING

(75) Inventors: Chak Yin Tang, Hong Kong (HK); Su Ping Bao, Kowloon (HK); Chi Pong Tsui, Hong Kong (HK); Tai Man Yue, Hong Kong (HK)

(73) Assignee: The Hong Kong Polytechnic University, Hung Hom, Kowloon (HK)

( * ) Notice: Subject to any disclaimer, the term of this patent is extended or adjusted under 35 U.S.C. 154(b) by 510 days.

(21) Appl. No.: 12/458,746

(22) Filed: Jul. 22, 2009

(65) Prior Publication Data

US 2011/0020168 A1 Jan. 27, 2011

(51) Int. Cl.

| | |
|---|---|
| ***C22C 14/00*** | (2006.01) |
| ***B22F 3/105*** | (2006.01) |
| ***B22F 3/11*** | (2006.01) |
| ***C22C 1/08*** | (2006.01) |
| ***C22C 26/00*** | (2006.01) |

(52) U.S. Cl.

CPC ..... *C22C 14/00* (2013.01); *B22F 3/105* (2013.01); *B22F 3/1121* (2013.01); *B22F 2003/1054* (2013.01); *B22F 2998/10* (2013.01); *C22C 1/08* (2013.01); *C22C 26/00* (2013.01)

(58) Field of Classification Search

CPC ..... C22C 14/00; C22C 1/08; B22F 3/105; B22F 3/1121

USPC ..... 420/417

IPC ..... B22F 2003/1054,3/1121

See application file for complete search history.

(56) References Cited

U.S. PATENT DOCUMENTS

| | | | | |
|---|---|---|---|---|
| 3,585,258 | A | 6/1971 | Levinson | |
| 5,002,488 | A | 3/1991 | Homsy | |
| 5,227,600 | A | 7/1993 | Blake et al. | |
| 5,252,267 | A | 10/1993 | Holcombe et al. | |
| 5,432,325 | A * | 7/1995 | Katz et al. | 219/759 |
| 5,989,027 | A | 11/1999 | Wagner et al. | |
| 7,291,012 | B2 | 11/2007 | Lyren | |
| 2005/0031704 | A1 * | 2/2005 | Ahn | 424/602 |
| 2005/0032025 | A1 | 2/2005 | Bhaduri et al. | |

OTHER PUBLICATIONS

I. C. Lavos-Valereto, I. Costa, and S. Wolynec. The Electrochemical Behavior of Ti-6Al-7Nb Alloy with and without Plasma-Sprayed Hydroxyapatite Coating in Hank's Solution. 2002 Wiley Periodicals, Inc. p. 664-670.

(Continued)

*Primary Examiner* — Weiping Zhu

(74) *Attorney, Agent, or Firm* — The Hong Kong Polytechnic University

(57) ABSTRACT

A method of fabricating a porous metal-based biomaterial, the method includes dispersing microwave susceptors into organic solvent to form a homogeneous suspension, dispersing bioactive fillers into organic solvent to form a homogeneous solution, mixing metal powder with the homogeneous solution and the homogeneous suspension to form a mixture, cold-pressing the mixture into a compact with predefined shape and size, placing the compact in a sintering container, and emitting microwave to heat the compact and remove the organic solvent resided in the compact at the same time.

8 Claims, 6 Drawing Sheets

(56) References Cited

OTHER PUBLICATIONS

D. E. MacDonald, F. Betts, M. Stranick, S. Doty, and A. L. Boskey. Physicochemical study of plasma-sprayed hydroxyapatite-coated implants in humans. 2000 John Wiley & Sons, Inc. p. 480-490.
Makoto Ogiso, Nobuo Nakabayashi, Toshio Matsumoto, Masao Yamamura, and Ramonito Rafols Lee. Adhesive improvement of the mechanical properties of a dense HA-cemented Ti dental implant. Journal of Biomedical Materials Research, vol. 30, 109-116(1996).
M. J. Filiaggi, R. M. Pilliar, and N. A. Coombs. Post-plasma-spraying heat treatment of the HA coating/Ti-6Al-4V implant system. Journal of Biomedical Materials Research, vol. 27, 191-198(1993).
Olivier Blind, Lorena H. Klein, Bruno Dailey, and Laurence Jordan. Characterization of hydroxyapatite films obtained by pulsed-laser deposition on Tiand Ti-6AL-4v substrates. Dental Materials (2005) 21, 1017-1024. Published by Elsevier Ltd.
C. Knabe, F. Klar, R. Fitzner, R. J. Radlanski, and U.Gross. In vitro investigation of titanium and hydroxyapatite dental implant surfaces using a rat bone marrow stromal cell culture system. Biomaterials 23 (2002) 3235-3245. Elsevier Science Ltd.
Bernard Finet. Georges Weber, and Rudi Cloots. Titanium release from dental implants: an in vivo study on sheep. Materials letters 43 (2000) 159-165. Elsevier Science B.V.
Young-Min Kong, Dong-Hwan Kim, Hyoun-Ee Kim, Seong-Joo Heo, and Jai-Young Koak. Hydroxyapatite-Based Composite for Dental Implants: an In Vivo Removal Torque Experiment. 2002 Wiley Periodicals, Inc. 714-721.
H. Schiefer, M. Bram, H. P. Buchkremer, and D. Stover. Mechanical examinations on dental implants with porous titanium coating. Mar. 26, 2009. Springer Science+Business Media, LLC 2009.
Hirofumi Kido, and Subrata Saha. Effect of HA Coating on the Dental Implants: Past, Present and Future Directions. 1997IEEE. p. 272-275.
M. G. Kutty, S. Bhaduri, and S. B. Bhaduri. Gradient surface porosity in titanium dental implants: relation between processing parameters and microstructure. Journal of Materials Science: Materials in Medicine 15 (2004) 145-150. 2004 Kluwer Academic Publishers.

* cited by examiner

RAPID FABRICATION OF POROUS METAL-BASED BIOMATERIAL BY MICROWAVE SINTERING

BACKGROUND OF THE INVENTION

1. Field of the Invention

The present invention relates to fabrication of implants, more particularly, to fabrication of porous metal-based biomaterial for implant dentistry and bone scaffold by microwave sintering.

2. Description of the Related Art

Over the years, a variety of metals have been used as raw materials for dental or bone implants until titanium was discovered having the inherent properties of osseointegration. As a result, titanium becomes one of the most common metals for dental implants because it displays high strength, excellent corrosion resistance and high strength-to-weight ratio. Today, titanium alloy has been widely used to create dental and orthopedic implants because of its excellent biocompatibility and mechanical properties. Most implants made of titanium alloy are fabricated via conventional powder metallurgy or melting production method.

In addition, with development of implant technology, more materials are found having chemical and biological properties that promote osseointegration, such as hydroxyapatite (HA). Hydroxyapatite is a natural and cost-effective candidate for dental implants due to its biocompatibility and its ability to support the growth of new bone tissue. Furthermore, the human bone is a composite of fibrous protein, collagen, and about 65 wt % of HA. Long-term clinical studies show that HA-coated titanium dental implants have excellent bioactivity.

Another commonly used method to improve the osseintegration of the metal-based implant to surrounding bone is through incorporation of a porous metal surface layer to the surface of the metal implants. This is done to improve the fixation of the implant to bone through in-growth of bone tissues into the porous layer. A common technique for coating a porous surface on the implant is plasma spraying technique, which is used for producing coatings and free-standing parts using a plasma jet. Then, the surface can be chemically etched or sandblasted to increase the surface area and the integration potential of the implant. However, there is a possibility that the coating surface may be loosen or detached from the metal implant.

Another shortcoming of the porous coating, as discussed in U.S. Pat. No. 7,291,012, is that porous surfaces are often a thin coating applied on a metal substrate of the implant. As such, bone surrounding the implant can only grow into the coating layer itself. The surrounding bone cannot grow through the coating and into the metal substrate. The depth of bone growth into the implant is limited to the depth of the porous coating.

While efforts have been made to produce metal-based implants with surface metal porosity, less effort has been made to create porous metal-based biomaterials for production of porous implants. It is therefore an objective of the invention to overcome the shortcomings of the conventional methods by providing a method for rapid fabrication of porous metal-based biomaterial that is lightweight, biocompatible, cost-effective and easy to produce. By taking advantage of the fast processing time of microwave sintering, the biological properties of the sintered compact can be preserved. Also, it is desirable to integrate biomaterial (e.g., HA) into the porous metal-based implant without having to provide a separate coating of a biomaterial.

SUMMARY OF THE INVENTION

According to an aspect of the present invention, a method of fabricating a porous metal-based biomaterial includes dispersing microwave susceptors with organic solvent to form a homogeneous suspension, dispersing bioactive fillers with organic solvent to form a homogeneous solution, mixing metal powder with the homogeneous solution and the homogeneous suspension to form a mixture, cold-pressing the mixture into a compact with predefined shape and size, and placing the compact in a sintering container and emitting microwave to sinter the compact.

According to another aspect of the present invention, a system for fabricating a porous metal-based biomaterial, includes a mixer adapted to mix metal powder, microwave susceptors, and bioactive fillers with organic solvent to form a compact, a molding unit adapted to mold the compact in a predetermined size and shape, and a sintering container adapted to hold the compact and sinter the compact by microwave radiation.

Further features and aspects of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

The accompanying drawings, which are incorporated in and constitute a part of the specification, illustrate embodiments of the invention and, together with the description, serve to explain the principles of the invention.

The present invention utilizes microwave energy to provide rapid fabrication of a porous metal-based biomaterial. Microwave technology has been widely used in various applications such as food processing, communication, and calcinations. Microwaves are electromagnetic waves with frequencies typically between 0.3 GHz and 300 GHz. There are some factors constraining the choice of the frequencies used in industrial or commercial microwave equipment. Hence, several frequencies are available for industrial, scientific or medical (ISM) application such as 434 MHz, 915 MHz and 2.45 GHz.

Microwave energy has been widely used in heating ceramic materials to a relatively high temperature that is suitable for sintering. In recent years, microwave sintering technology for metallic materials has been developed. For example, U.S. Pat. No. 5,227,600 discloses a method for producing articles of alumina and alumina silicon carbide using microwave radiation.

Figure 1A:
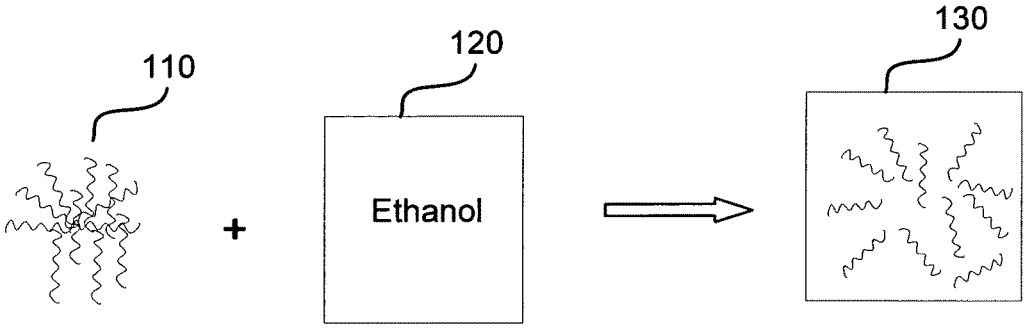
FIGS. 1A and 1B illustrate exemplary methods for dispersion of microwave susceptors and bioactive fillers in organic solvents such as ethanol, respectively.

FIG. 1A illustrates an exemplary method for dispersion of microwave susceptors in solid form 110 in an organic solvent such as ethanol 120 to form a solution with dispersed microwave susceptors in solid form 130. The microwave susceptors in solid form 110 is capable of absorbing electromagnetic energy (microwave energy), and convert the electromagnetic energy to heat energy. The susceptors in solid form 110 includes carbon black, carbon nanotubes, carbon nanofibers, and other types of carbon fillers. It is noted that organic solvent with polar molecules that could couple directly with microwaves can generate heat rapidly and play a similar role to other microwave susceptors. The total weight of the microwave susceptors may range from 5 wt % to 15 wt % of the total weight of the solution. The size of microwave susceptors can range from nanometer to micrometer scale.

Figure 1B:
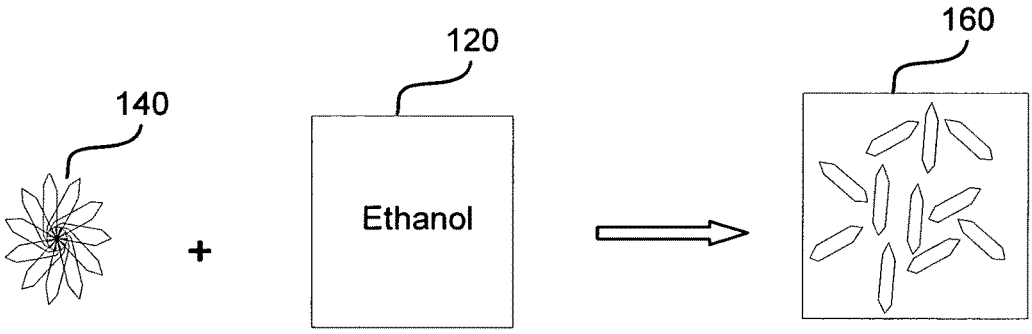

FIG. 1B illustrates an exemplary method for dispersion of bioactive fillers 140 such as hydroxyapatite (HA) powder, by mixing with an organic solvent such as ethanol 120 to form a solution with dispersed bioactive fillers 160. Hydroxyapatite 140 typically has a composition of $Ca_{10}(PO_4)_6(OH)$, however, the present invention does not limit to a particular type of hydroxyapatite 140. The ratio of organic solvent to hydroxyapatite (HA) is initially fixed at 10:1. The amount of the organic solvent left in the mixture is dependent on the composition and the geometrical scale of articles for microwave sintering. Less than 10 wt % of the organic solvent may be left in the compact. The incorporation of liquid ethanol is beneficial for microwave sintering of the compact.

Figure 2:
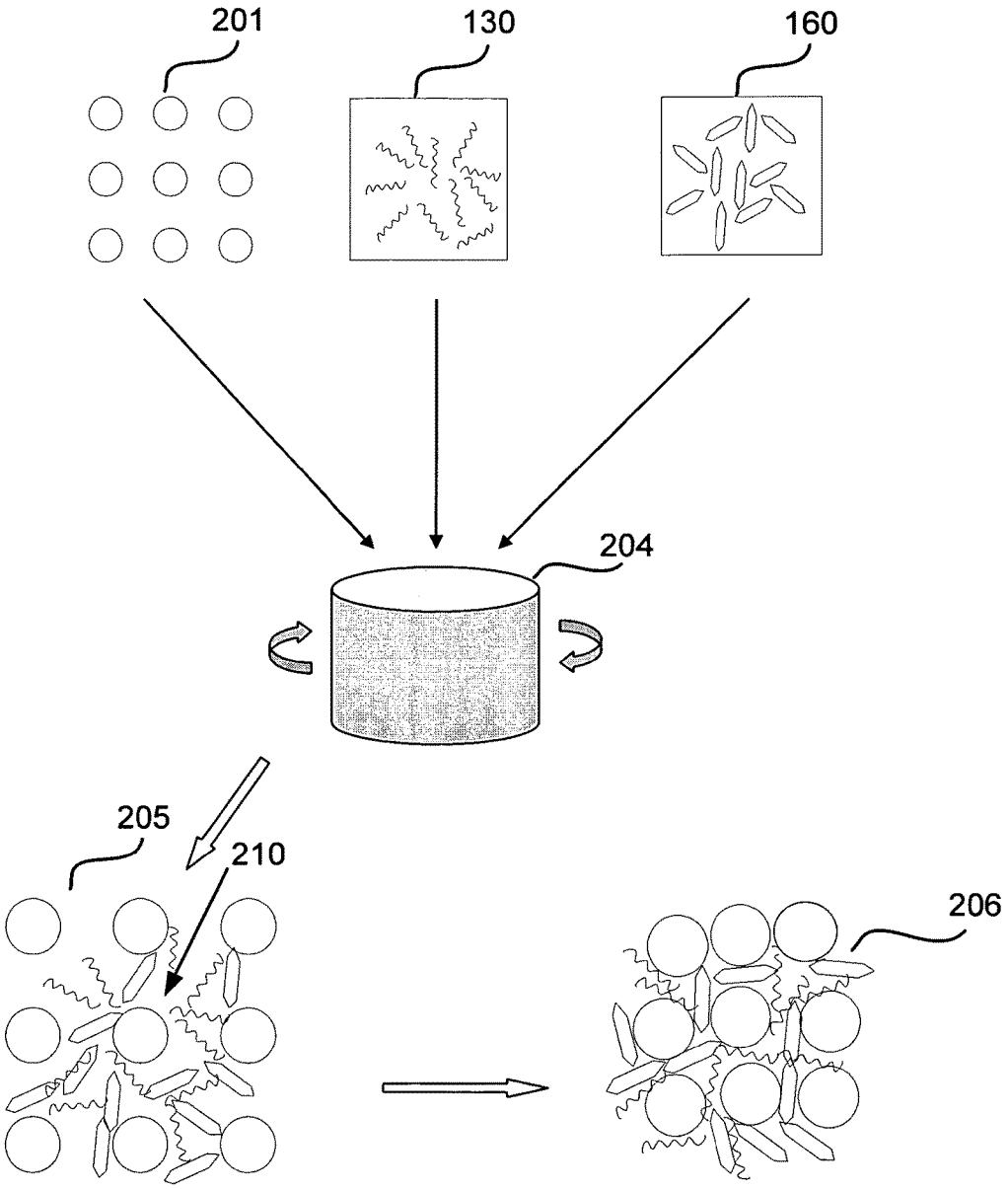
FIG. 2 illustrates an exemplary process for mixing metal powder with the dispersed materials.

In FIG. 2, metal powder 201 such as pure titanium powder, the dispersed carbon fillers in the organic solvent 130, and the dispersed hydroxyapatite in the organic solvent 160 are added in a container 204 for mixing. The solution 205 is prepared by ultrasonic dispersion and then air-dried at room temperature until approximately 90 wt % of the organic solvent is evaporated. The usage of a vacuum pump can shorten the evaporation time of organic solvent to twenty minutes or less depending on the volume of the organic solvent.

Then, cold pressing is performed onto the mixture of titanium powder 201, the dispersed microwave susceptors in organic solvent 130 and hydroxyapatite powder 160 using a molding unit (not shown) to create a desire shape and size. As shown in FIG. 2, prior to cold pressing, voids and cavities 210 exist among the mixture. After cold pressing, the mixture has been densified into a compact 206 with the size and shape of an artificial replacement implant of a patient.

Figure 3:
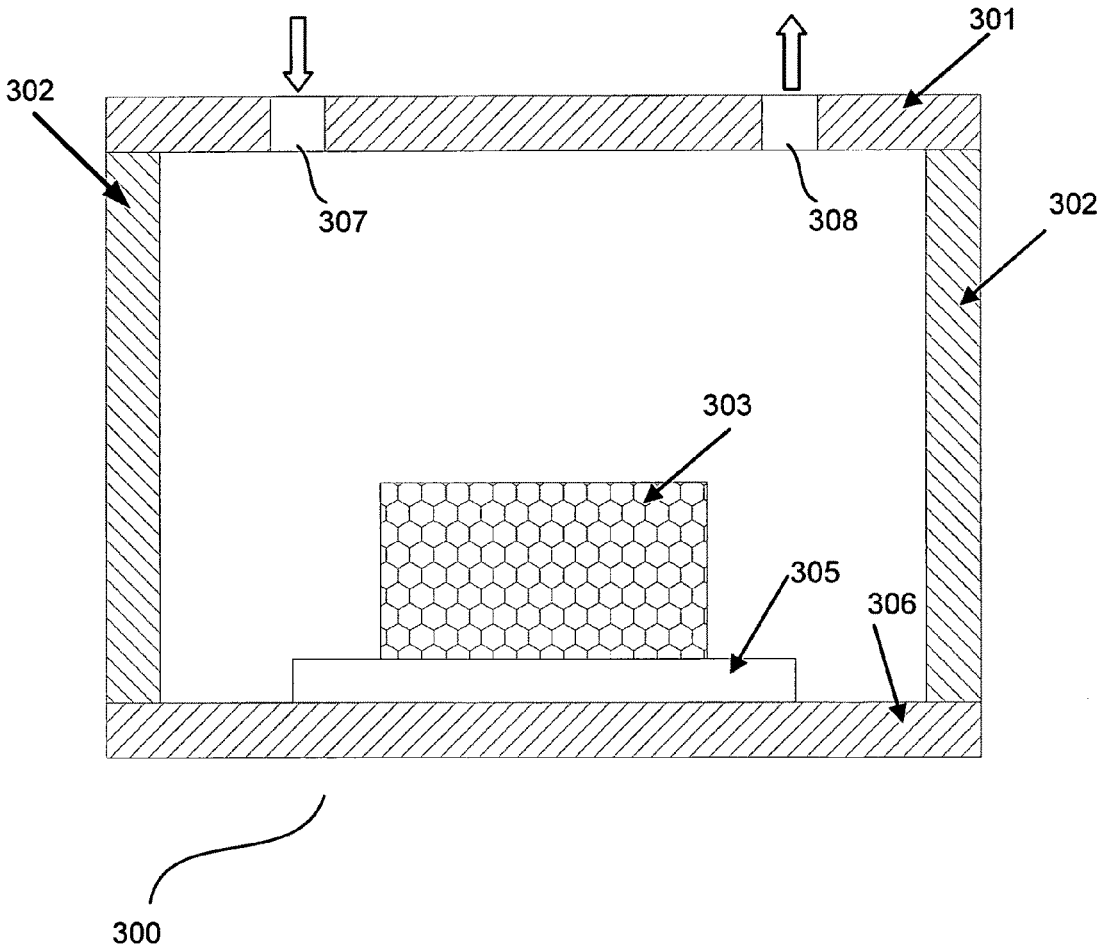
FIG. 3 illustrates a side-view of a microwave sintering container containing a compact.

FIG. 3 discloses a microwave sintering container 300, the container 300 includes an upper wall 301, impervious walls 302, a removable plate 305, and a base 306. Inert gas such as argon or helium may be input into the sintering container via gas inlet 307 and exit from the sintering container via gas outlet 308.

The microwave container 300 is made of an insulation material that does not absorb microwave radiation. The compact 303 is placed on the insulation unit 300 via an opening of the microwave container. Removable plate 305 is adapted to support the compact as well as to serve as a heat insulator between the compact and the base part of microwave container 300. The removable plate 305 may be capable of rotating during the emission of microwave. Removable plate 305 should be made from a material that is transparent to microwaves so that it does not heat to a significant degree by microwave radiation. Then, microwave radiation is emitted to the compact 303 to perform microwave sintering. Removable plate 305 is made from a high temperature-resistant material with high microwave transparency. It should be capable of withstanding localized high heat emitted from sintering articles to prevent from damaging the sintering container 300.

When performing microwave sintering in the power range of 500 W-1000 W in the case of titanium powder, which has a melting point at about 1725° C., the compact is heated for 30 seconds to 5 minutes. The frequency of microwave emission is fixed at about 2.45 GHz. As discussed previously, the microwave susceptors convert the electromagnetic energy into thermal energy. During the sintering process, portions of the microwave susceptors are burned off from the heat generated. As a result, a porous metal-based biomaterial is created. By controlling the amount of concentration of the microwave susceptors and other processing parameters, the degree of porosity in the biomaterial can be controlled. In addition, since microwave sintering only take less than a few minutes to complete, the decomposition of HA will be minimized.

Figure 4:
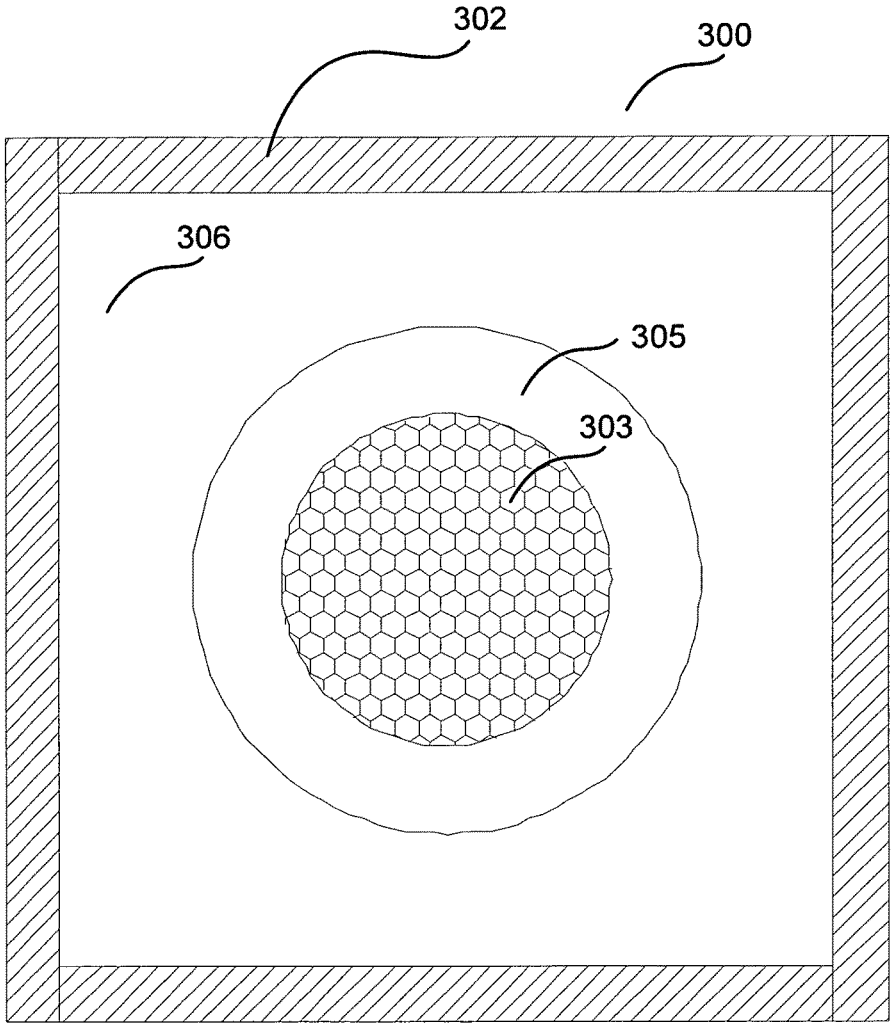
FIG. 4 illustrates a top-view of a microwave sintering container containing a compact.

FIG. 4 is a top-view of the sintering container. It also contains impervious walls 302, a removable plate 305, and a base 306.

Figure 5:
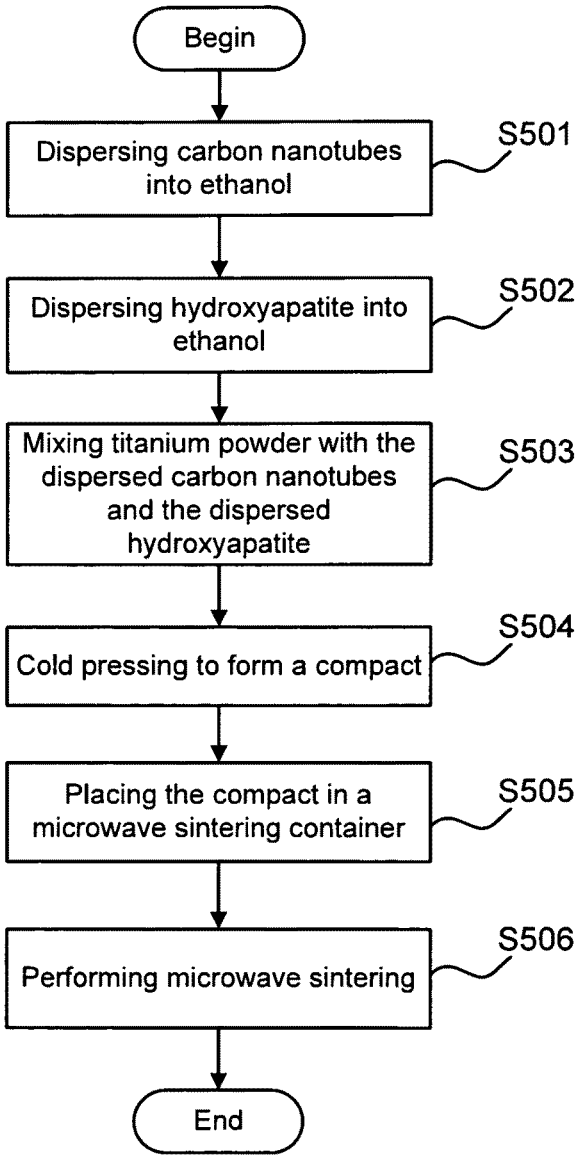
FIG. 5 illustrates an exemplary process flow for fabricating a porous titanium-based biomaterial.

FIG. 5 illustrates an exemplary process flow for fabricating a porous titanium-based biomaterial. In step S501, microwave susceptors such as carbon nanotubes are dispersed into ethanol as shown in FIG. 1A. Next, in step S502, bioactive filler such as hydroxyapatite powder is dispersed into ethanol, as shown in FIG. 1B. In step S503, titanium powder is mixed with the dispersed carbon nanotubes and the dispersed hydroxyapatite to form a mixture. Then, a mixture of the titanium powder, dispersed carbon nanotubes, and dispersed hydroxyapatite is created.

Next, after most of the ethanol in the mixture is evaporated, cold pressing (S504) is then performed on the mixture to create a compact by using a molding unit with a predefined shape and size. Thereafter, the compact is placed in the microwave sintering container (S505). In next step S506, microwave sintering of the compact is performed.

Figure 6:
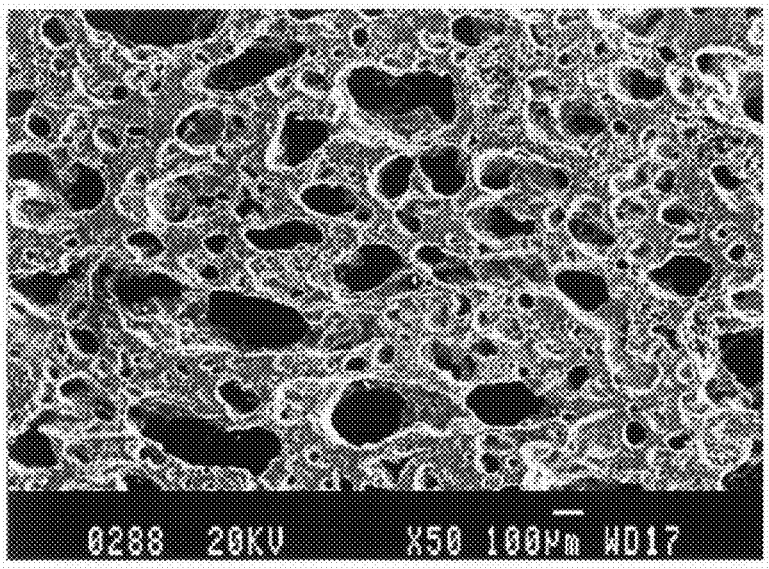
FIG. 6 is an example of a SEM micrograph of a porous titanium-based biomaterial.

FIG. 6 shows a scanning electron microscope (SEM) micrograph of a porous titanium-based biomaterial after microwave sintering. As shown in FIG. 6, a porous metal-based biomaterial is created. The morphology of formed porous titanium-based biomaterial depends on the concentration of microwave susceptor used and other processing parameters such as the sintering time, the pressure applied in the cold pressing method and the dispersion technique and so on. Open porous structure with size 100~200 μm can be formed using carbon nanotubes as microwave susceptor agent. It is noted that the bioactive fillers left in the porous metal-based biomaterial sintered and the special porous structure are crucial to provide the biocompatibility of the biomaterial applied for dental implant or other bone replacements.

The invention presents a method to produce a metal-based material with porous structure. Processing duration and cost is significantly reduced by using microwave as the energy source. For instance, the present microwave sintering process only takes several minutes to complete with the aid of a carbonic substance as a susceptor agent. By properly modulating processing conditions and controlling the composition, metal-based biomaterial with various porosity can be achieved. Furthermore, the present microwave sintering technique is suitable for batch production as well as patient-specific fabrication of implant structures without investment of expensive apparatus. In addition, a special feature of the invention is the inclusion of bioactive agent in the material while bioactive agent is usually coated on the surface of the conventional biomaterials used for dental implants.

While the present invention has been described with reference to exemplary embodiments, it is to be understood that the invention is not limited to the disclosed exemplary embodiments. The scope of the following claims is to be accorded to the broadest interpretation so as to encompass all modifications and equivalent structures and functions.

What is claimed is:

1. A method of fabricating a porous metal-based biomaterial for dental and orthopedic implants, the method comprising:

dispersing carbon-based microwave susceptors into a first organic solvent to form a homogeneous suspension, the carbon-based microwave susceptors are in micrometer or nanometer scale;

dispersing bioactive fillers into a second organic solvent to form a homogeneous solution;

mixing titanium or titanium alloy powder with the homogeneous solution and the homogeneous suspension to form a metal-based mixture;

cold-pressing the metal-based mixture into a metal-based compact; and placing the metal-based compact in a sintering container and emitting microwave to sinter the metal-based compact, and remove the first and/or second organic solvent resided in the metal-based compact at the same time, wherein the carbon-based microwave susceptors are burned off by heat generated during the microwave sintering to form porosity.

2. The method according to claim 1, wherein the first and/or second organic solvent is ethanol.

3. The method according to claim 1, wherein the carbon-based microwave susceptors include carbon blacks, carbon nanotubes, carbon nanofibers, and carbon fillers, the carbon-based microwave susceptors having 5% to 15% of total weight.

4. The method according to claim 1, wherein the bioactive fillers are hydroxyapatite powder.

5. The method according to claim 1, wherein the metal-based mixture is placed in a molding unit for a predefined size and shape.

6. The method according to claim 1, wherein the microwave emission has a frequency of 2.45 GHz.

7. The method according to claim 1, wherein the first and second organic solvents are the same.

8. The method according to claim 1, wherein the first and second organic solvents are different.

* * * * *